US005816072A

United States Patent [19]

Michaels

[11] Patent Number: 5,816,072

[45] Date of Patent: Oct. 6, 1998

[54] JEWELRY WITH LINKS AND VISIBLE SUBSTRATE

[76] Inventor: Thomas Michaels, RR1, Box 4065A, Camden, Me. 04843

[21] Appl. No.: 931,759

[22] Filed: Sep. 16, 1997

Related U.S. Application Data

[63] Continuation of Ser. No. 252,841, Jun. 2, 1994, abandoned.

[51] Int. Cl.[6] ..... A44C 5/00

[52] U.S. Cl. ..... 63/3; 63/11; 63/34

[58] Field of Search ..... 63/11, 3, 29.1, 63/31, 34, 33

[56] References Cited

U.S. PATENT DOCUMENTS

| | | | |
|---|---|---|---|
| 243,793 | 7/1881 | Richards | 63/11 |
| 306,936 | 10/1884 | Logan | 63/11 |
| 1,694,703 | 12/1928 | Doppenschmitt | 63/11 |
| 2,282,336 | 5/1942 | Meyer | 63/11 |
| 3,165,825 | 1/1965 | Barney | 63/2 |
| 3,955,934 | 5/1976 | Tizzi | 63/2 |
| 4,357,694 | 11/1982 | Montoori | 63/11 |
| 4,490,440 | 12/1984 | Reber . | |
| 4,936,699 | 6/1990 | Yoshida | 63/11 |
| 5,630,329 | 5/1997 | Lauffer | 63/11 |

FOREIGN PATENT DOCUMENTS

| | | | |
|---|---|---|---|
| 316235 | 9/1956 | France | 63/11 |
| 1460161 | 11/1965 | France | 63/11 |
| 148035 | 9/1983 | Japan | 63/2 |
| 6007210 | 1/1994 | Japan | 63/2 |
| 334752 | 1/1959 | Switzerland | 63/11 |
| 338992 | 7/1959 | Switzerland | 63/11 |
| 1210385 | 10/1970 | United Kingdom . | |

OTHER PUBLICATIONS

Jan., 1994 issue of Oro Italia advertisement (page not known).

*Primary Examiner*—Flemming Saether
*Attorney, Agent, or Firm*—Pierce Atwood

[57] ABSTRACT

A novel piece of jewelry providing a substrate to which one or more link elements may be affixed. The substrate is formed essentially entirely of a non-gold metal that is ductile and sufficiently elastic so that after being formed into a particular shape it will spring back to that shape after being stressed. In order to make the substrate an aesthetically-pleasing part of the jewelry, the non-gold metal used is of a type that may be colored. Suitable substrate metals include, but are not limited to, titanium, tantalum, steel, and a variety of other similar types of metals. The appearance of the substrate permits the use of a wide array of links that may be solid or that may be open-gallery having a broad range of designs. The links may be permanently or temporarily affixed to the substrate.

8 Claims, 1 Drawing Sheet

JEWELRY WITH LINKS AND VISIBLE SUBSTRATE

This is a continuation of application Ser. No. 252,841, filed Jun. 2, 1994, now abandoned.

BACKGROUND OF THE INVENTION

1. Field of the Invention

This invention relates to jewelry to be worn on the body or to be placed on clothing. More particularly, the present invention relates to jewelry formed of a combination of components wherein one of the components is a substrate to which one or more ornamental elements are affixed. The invention includes a novel technique for producing the substrate and a novel technique for joining the ornamental elements and the substrate.

2. Description of the Prior Art

In the field of high-quality, or fine, jewelry, particularly gold jewelry, it is difficult to provide relatively large pieces at a reasonable, "wearable" weight while qualifying such jewelry as a certain type, i.e., 14-karat, 18-karat, etc. That is because the density of gold is much higher than many other elemental metals. As the size of the piece gets larger in scale, it weighs more and therefore costs more. This is particularly so in the case of wrist and neck pieces. For many people it is undesirable to exert the energy necessary to wear a heavy piece of jewelry for any extended length of time. They therefore turn to costume jewelry made of much lighter components, such as plastic. In this way, the jewelry that can be displayed comfortably is much less restricted in terms of size. However, the quality of the jewelry is also considerably less than that of gold jewelry of the type noted above. It would be preferable to maintain the high quality of the jewelry without restricting severely the size of the piece to be worn.

Another limitation of the high-quality fine gold jewelry presently available relates to the color of the piece. Gold, of course, provides a limited color range. In order to make a piece of jewelry more colorful it is generally necessary to add non-gold components. That may be achieved by adding precious and semi-precious stones to a gold substrate. However, such additions can rapidly price the piece well beyond the spending range of most people. Alternatively, colored non-precious elements may be used to enhance the appearance of a piece.

A limitation specifically directed to the type of jewelry that includes band bracelets, band neckpieces and the like, relates to the substrate upon which such jewelry pieces are deployed. (Band, in the context of this application, means sheet stock that can be worked into a variety of shapes.) Typically, high-quality fine gold jewelry that is formed by combining a plurality of links or individual elements and that is of the "open-cuff" type includes a spring-like substrate. The open-cuff type jewelry has an opening that is expanded by the wearer so that the piece can be placed on the wrist for a bracelet, on the ankle of an anklet, etc. Since this may be done many times over the life of the piece, it is necessary to have a substrate with some elasticity. While the substrate can be fabricated of gold, it is often made of steel. If the substrate is made of gold, the piece is quite heavy. If the substrate is made of steel, it is not desirable to have it viewed in any way. As a result, the links of the jewelry piece are essentially solid and are joined together so that the substrate cannot be seen. This naturally increases the weight and cost of the piece. In addition, at least the end links are normally soldered to the substrate, thereby limiting the option of making subsequent modifications to the piece.

What is needed is jewelry that includes a substrate upon which one or more elements may be deployed. The substrate to have the high-quality and formability obtained by using gold but without the weight and expense associated with gold. What is also needed is jewelry having a substrate that may be produced in a variety of colors such that the substrate may form a part of the appearance of the jewelry.

SUMMARY OF THE INVENTION

It is an object of the present invention to provide jewelry having a combination of components, with a key component being a formable spring-like substrate. It is another object of the present invention to provide jewelry having a substrate that weighs less and/or that is less expensive than gold. It is still another object of the present invention to provide a jewelry substrate to which elements may be permanently or temporarily affixed. Yet another object of the present invention is to provide jewelry with a substrate that may be produced in a variety of colors and that does not corrode under the conditions to be expected for jewelry that is in use.

These and other objects are achieved in the present invention by the use of a non-gold metal substrate as the base upon which additional elements may be deployed. The substrate metal may be any one of a variety of the elemental metals, as well as metal alloys, provided the substrate metal is sufficiently ductile to be formed into a desired shape without fracture. In addition, the metal substrate must be selected so that it will not "fatigue" after many cycles of applied stress, such as, for example, when the particular jewelry piece is a bracelet band that is opened and closed many types as it is placed on and taken off the wrist. Of course, for a jewelry piece that does not experience such cycles of stress, such as a ring, it is not necessary to provide a substrate with as much elasticity.

18-karat white gold, which is approximately 75% gold, has a specific gravity of 14.6, equivalent to a density of about 0.7 pounds per cubic inch. It has excellent corrosion resistance. It is also relatively easy to form and has good "spring-back" characteristics. That is, gold of the type normally used in jewelry is sufficiently elastic that it will return to its originally formed shape after repeated cycles of stress. Unfortunately, the capability to color gold is extremely limited, it is expensive, and its density necessarily places a limit on the size of a piece of jewelry to be produced. In order to overcome the limitations associated with gold, while still providing high-quality jewelry, the present invention replaces the substrates currently in use with non-gold metal substrates. The non-gold substrates that have been evaluated that are sufficiently formable, that are not prone to surface distress under normal wear conditions, and that have good spring-back characteristics include, broadly, most all of the precious and non-precious metals and their alloys, and ferrous and non-ferrous metals and their alloys. While this naturally covers a very wide range of materials, it is to be noted that the key feature of the present invention is the use of a formable material that has spring-back characteristics as the substrate, wherein that substrate is colorable and/or otherwise capable of being formed in a variety of textures. Particular metals that have been found to be useful include, but are not limited to, titanium and its alloys, steel and its alloys, aluminum and its alloys, copper and its alloys, tantalum, vanadium, zirconium, beryllium, and those metals generally referred to as the hypothermic metals. In addition, in some situations it may be useful to use a variety of metals in combination with others, such as when two or more metals are fused or otherwise combined to create multiples of colors and novel textures. Metals found to be desirable in this arrangement include, but are not limited to, niobium, the noble metals and their alloys, such as gold, silver, and platinum. Of course, it is to be understood that those skilled in the art will be aware of those metals and those combinations of metals that would be suitable for the present invention.

In addition to having desired physical characteristics, the listed metals have densities that are much less than the density of gold. As a result, they may be used to produce either larger jewelry pieces or pieces that are the same size as gold pieces but that weigh much less. Further, the listed metals may be colored in any number of well-known ways, including, but not limited to, controlled oxidation of the metal surface through an electro-immersion process, heat application, or a chemical oxidation process so that an interference effect is created on the surface, resulting in a rainbow-like array of colors. Other coloring techniques include: 1) controlled corrosion of the metal surface, particularly that of copper and its alloys, so as to form a color layer generally comprising copper-sulfate; 2) patinization; 3) electroplating; 4) pigmenting, or otherwise applying a coating to the metal; 5) etching; 6) embossing; 7) abrasive blasting; 8) fusing; and 9) anodization. Moreover, other colors and piece textures may be created by other well-known ways, including, but not limited to: 1) mokume gami, a fusing of multiple layers of metal; 2) in letting, inserting of one metal into another; 3) fusing. It has been observed that niobium is particularly suitable for combining with other metals as it provides brilliant colors. Combinations of colors and designs may further be created by masking portions of the substrate and introducing such colors and designs utilizing photoresist and mechanical resist processes in predetermined arrangements, all as understood by those skilled in the art.

The principally non-gold substrate of the present invention may be formed into a wide array of shapes. When used as the substrate for a bracelet, anklet, or neckpiece, the substrate may be formed into a generally circular shape. This type of piece may be in the form of a band or it may be in the form of a wire. Such a piece can be fabricated with a clasp so that when the clasp is deployed there is no opening by which the piece may slip off. Alternatively, the piece may be formed so that there is an opening such that the opening must be expanded in order to place the jewelry piece on the arm, ankle, neck, etc. Once the piece is in place, release of the substrate causes the piece to fit securely without the possibility that the piece will slip off. In that design, it is important that the substrate be sufficiently elastic so that many cycles of expanding the opening and allowing the piece to spring back to its original shape will not cause a relaxation of the substrate to the point that the opening remains in an expanded state.

It is well known in the jewelry industry that supplemental components or "links" may be placed on a substrate of the type just described. These links may be open so that the underlying substrate can be observed, or they may be closed so that only the face of the link is observed. If the underlying substrate is formed of a gold, the links may be open-faced. If the substrate is the standard steel normally in use, the links are generally solid. These links may be precious or non-precious metal, precious, semi-precious, non-precious stones, and/or synthetic stones, or a combination of such components. It is standard in the industry to place a plurality of such links together so that there is no space between adjacent links, particularly when the maker does not wish to have the substrate seen, as, for example, when the links are beads and the substrate is not gold. As a result, there are two layers of components forming the jewelry, generally only one of which is actually seen. Through the application of the colorable substrate of the present invention, the substrate may be used not only as a support for the featured link components, it may also be used as an aesthetic feature of the jewelry. In that way, fewer links may be deployed, links may no longer have to be placed in close proximity to one another, and links that are formed with "gallery openings" which display the underlying substrate may be used. The ability to reduce the number and/or size of the links, in combination with the use of substrate metals that are lighter than gold, greatly increases the options available to the jeweler or jewelry designer with regard to size and shape of a piece. It also reduces the strain on the jewelry wearer and reduces the cost to produce and sell high-quality fine jewelry.

Although reference has been made to substrates formed as bands or wires, it is to be understood that the substrate of the present invention may simply be formed as a flat component which by itself, or in combination with an additional element, may be a jewelry piece. For example, the colorable substrate of the present invention may be part of an earring, a brooch, a ring, tie tack, tie bar, cufflinks, or the like. These types of pieces do not require the substrate to have the spring-back characteristic necessary for the pieces previously described.

Most of the jewelry currently available and employing a substrate to which one or more links is/are affixed generally make that fixation permanent. That is, the links are typically soldered to the substrate. It is contemplated in the present invention to provide the option of fixing the links either permanently by standard means, or by making such fixation temporary, such as by using screws or rivets. Each link on a given substrate may be secured to the substrate by means of a screw, or just the end links may be so secured. For a wire substrate having beads placed thereon, the beads at either end may be end caps. Through these various means of temporary affixation a single substrate may be used with a variety of link designs to form a variety of jewelry pieces at much less cost.

These and other aspects and advantages of the present invention will be better understood with reference to the following description, the drawings, and the appended claims.

DESCRIPTION OF PREFERRED EMBODIMENTS OF THE INVENTION

Figure 1A:
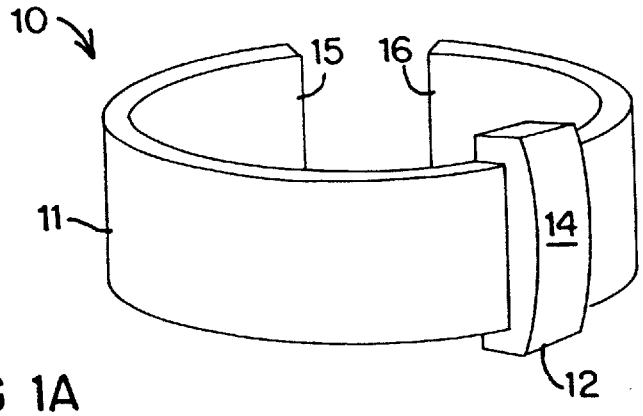
FIG. 1A is a perspective view of a bracelet piece of the jewelry of the present invention, showing the colorable substrate band having one link placed thereon, with the display face of the link facing forward.
Figure 1B:
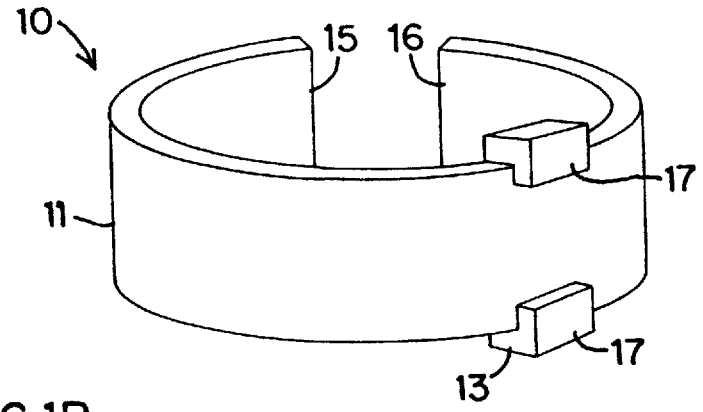
FIG. 1B is a perspective view of a bracelet piece of the jewelry of the present invention, showing the colorable substrate band having one link placed thereon, with the display face of the link facing rearward.

A jewelry piece of the present invention in the form of a band bracelet 10 is shown in FIGS. 1A and 1B. The bracelet 10 illustrated is of the type know as an open-cuff form, and it includes a band substrate 11 and one or more links, one of which is illustrated as first link 12 in FIG. 1A and as second link 13 in FIG. 1B. It is to be understood that one or more of the links illustrated may be combined on a single substrate so as to produce the jewelry of the present invention. Also, the links used in the present invention may be of the type generally used in this field. The first link 12 and the second link 13 may be fabricated of a variety of materials, including gold, stones, or a combination of gold and stones. Although the links illustrated in FIGS. 1A and 1 B are shown as solid pieces, they may alternatively have openings, generally identified as pierced motifs or "galleries," forming part of a link face 14 so that the underlying substrate 11 can be seen. The links shown in FIGS. 1A and 1 B are deployed on the substrate 11 by sliding them on at a first substrate end 15 or at a second substrate end 16. Once placed in a desired position, the link may be secured to the substrate 11 either by permanently soldering it in place (if it is made of a material suitable for soldering), temporarily fixing it in place by means of screws, rivets, etc., or by simply locking it to the substrate 11 by means of tabs 17. If the links 12 and 13 are locked to the substrate 11 by the tabs 17, they may easily be moved from one position to another with minimal effort. If the links 12 and 13 are temporarily fixed in position by means of screws or the like, they may later be redeployed. Of course, if the links 12 and 13 are permanently affixed, they cannot be removed without damaging the substrate 11.

The substrate 11 of the present invention may be formed of a variety of non-gold metals, including but not limited to, titanium and its alloys, steel and its alloys, aluminum and its alloys, copper and its alloys, tantalum, vanadium, zirconium, beryllium, and those metals generally referred to as the hypothermic metals. Preferably, the substrate 11 is fabricated of titanium, which has a specific gravity of about 4.5 (density of about 0.16 pounds per cubic inch), approximately one-third the density of gold. In one embodiment of the present invention the titanium is Grade 1 or 2 that is milled or rolled and work hardened to two or three gauges of work hardness. For the substrate 11 illustrated in FIGS. 1A and 1B, the titanium piece may be formed in a variety of widths, although a width of about one inch is standard in the field of similar jewelry. The hardened titanium frame stabilizer that is the substrate 11 of the present invention is then formed into an open circular shape as shown, and then subsequently oxidized in a standard electro-immersion process, developing a specific oxide thickness so as to provide a calculated interference pattern to be set up on the substrate for the refraction of light to occur. Those skilled in the art are familiar with this technique for manipulating the appearance of this particular metal. Of course, the interference pattern creates a coloring effect that may be varied in a calculated way. Alternatively, the titanium may be colored by some other means, such as by one of the techniques previously referenced.

As previously noted, it is possible to produce the substrate 11 from other non-gold metals that are relatively lightweight and that have reasonable formability and spring-back characteristics. The other non-gold metals of the type previously listed, may be formed into the substrate 11 design in a manner similar to that described for the titanium. That is, they may be milled, or rolled and work hardened into the desire shape, as is generally known by those familiar with metalworking procedures. In addition, as has been previously noted, a plurality of such metals may be fused or otherwise joined together to form the substrate 11 as a plurality of metals in a manner known to those skilled in the art of joining metals. Niobium may be used in combination with one or more other metals, wherein the niobium is useful for color while it needs a more robust metal mate to provide the spring and formability to produce a suitable substrate. Stainless steel is a suitable alternative, particularly when it is desirable to have a black substrate. However, stainless steel is approximately twice as dense as titanium.

Figure 2:
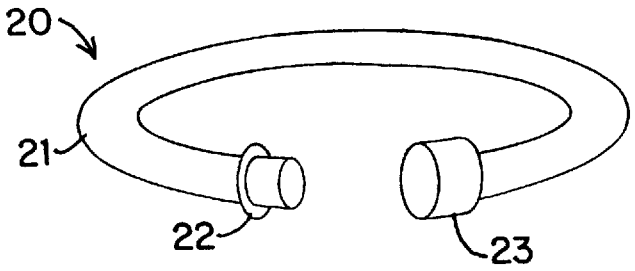
FIG. 2 is a perspective view of a piece of jewelry of the present invention, showing a substrate that is a wire with one or more beads deployed thereon.

In an alternative form of the present invention illustrated in FIG. 2, a jewelry piece in the form of a beaded bracelet or neck piece 20 includes a wire substrate 21 and a plurality of beads 22. Instead of forming the wire substrate 21 from flat sheet stock as would normally be used in making the band substrate 11, the wire substrate 21 is instead fabricated from metal wire that is easily formable into a necklace, bracelet, or similar type of flexible piece. The wire may be round with a diameter of about 0.25 inch, or it may be formed into an alternative shape. The wire substrate 21 can be colored in any of the ways previously described. The beads 22 may be temporarily affixed to the wire substrate 21 by riveting them or screwing them to the substrate 21. Alternatively, if formed of a suitable material, the beads 22 may be permanently secured to the substrate 21 by soldering or other means so as to allow for a calculated, permanent spacing. The use of a colorable substrate as part of the jewelry of the present invention permits a jeweler or a jewelry designer to allow the beads 22 to move freely on the substrate 21 so that the substrate 21 may be displayed. Of course, it would be necessary to at least fix end cap beads 23 to the substrate 21 so that the plurality of beads 22 would not slip off with any sort of movement.

Although the present invention has been described with reference to a particular preferred embodiment, variations on component orientations, materials of fabrication, and methods of attachment, among other features, will be readily apparent to those skilled in the art. Therefore, it is to be understood that alterations and equivalents may be made of the invention as described without deviating from its basic attributes.

I claim:

1. An article of jewelry comprising a substrate and one or more links, wherein said substrate is a curved rectangular-shaped band having an inner surface adapted to be facing a user, and an outer surface, wherein said band is formed as a single piece of a non-gold metal, wherein said non-gold metal is formable into a predetermined shape having a first end and a second end, wherein said non-gold metal is sufficiently flexible so that when deformed it will spring back to approximately its original predetermined shape, wherein said non-gold metal is colorable, wherein said first end and said second end of said band are non-overlapping such that said band is formable into a partial cylinder having an opening, and wherein said one or more links are deployed on said substrate, and wherein each link only partially encompasses said substrate such that at least a portion of said outer surface of said substrate is visible.

2. The article of jewelry as claimed in claim 1 wherein said non-gold metal is titanium.

3. The article of jewelry as claimed in claim 1 wherein said non-gold metal is steel.

4. The article of jewelry as claimed in claim 1 wherein said band is designed to have an opening such that said opening must be expanded in order to move said band to a desired position.

5. An article of jewelry comprising a substrate and one or more links, wherein said substrate is a curved rectangular-shaped band having an inner surface adapted to be facing a user, and an outer surface, wherein said band is formed as a single piece of a combination of a plurality of metals, wherein at least one metal of said plurality of metals is formable into a predetermined shape having a first end and a second end, wherein at least one metal of said plurality of metals is sufficiently flexible so that when deformed it will spring back to approximately its original predetermined shape, wherein at least one metal of said plurality of metals is colorable, wherein said first end and said second end of said band are non-overlapping such that said band is formable into a partial cylinder having an opening, wherein said one or more links are deployed on said substrate, and wherein each link only partially encompasses said substrate such that at least a portion of said outer surface of said substrate is visible.

6. The article of jewelry as claimed in claim 5 wherein one of said metals is titanium.

7. The article of jewelry as claimed in claim 5 wherein one of said metals is steel.

8. The article of jewelry as claimed in claim 5 wherein said band is designed to have an opening such that said opening must be expanded in order to move said band to a desired position.

* * * * *